US009295302B1

(12) United States Patent
Reed et al.

(10) Patent No.: US 9,295,302 B1
(45) Date of Patent: Mar. 29, 2016

(54) GAIT-ALTERING SHOES

(71) Applicants: Kyle B. Reed, Tampa, FL (US); Ismet Handzic, Lutz, FL (US)

(72) Inventors: Kyle B. Reed, Tampa, FL (US); Ismet Handzic, Lutz, FL (US)

(73) Assignee: University of South Florida, Tampa, FL (US)

( * ) Notice: Subject to any disclaimer, the term of this patent is extended or adjusted under 35 U.S.C. 154(b) by 563 days.

(21) Appl. No.: 13/769,632

(22) Filed: Feb. 18, 2013

Related U.S. Application Data

(60) Provisional application No. 61/600,267, filed on Feb. 17, 2012.

(51) Int. Cl.
*A43B 7/14* (2006.01)

(52) U.S. Cl.
CPC ..... *A43B 7/14* (2013.01)

(58) Field of Classification Search
CPC ..... A47B 7/14; A47B 7/141; A47B 3/00; A47B 3/0005
See application file for complete search history.

(56) References Cited

U.S. PATENT DOCUMENTS 942,333 A * 12/1909 Lennox ..... A63C 17/12 280/11.115
4,416,293 A * 11/1983 Anderson ..... A63B 22/02 348/77
4,600,016 A * 7/1986 Boyd ..... A61B 5/1038 600/592
4,631,676 A * 12/1986 Pugh ..... A61B 5/1038 348/77
4,745,930 A * 5/1988 Confer ..... A43B 3/0005 600/592
4,813,436 A * 3/1989 Au ..... A61B 5/1038 356/620
5,299,454 A * 4/1994 Fuglewicz ..... A63B 22/02 600/592
5,382,052 A * 1/1995 Tarng ..... A63C 1/306 280/11.27
5,474,087 A * 12/1995 Nashner ..... A61B 5/1036 482/54
5,607,376 A * 3/1997 Magid ..... A47D 13/04 482/54
5,613,690 A * 3/1997 McShane ..... A63B 22/18 273/449
5,831,937 A * 11/1998 Weir ..... A61B 5/1038 367/128
5,899,963 A * 5/1999 Hutchings ..... A43B 3/0005 700/14
5,947,486 A * 9/1999 Zell ..... A43B 5/1641 280/11.201
5,955,667 A * 9/1999 Fyfe ..... A43B 3/0005 702/160
6,059,062 A * 5/2000 Staelin ..... A43B 5/16 180/181
6,162,151 A * 12/2000 Tani ..... A63B 21/4009 482/54
6,237,923 B1 * 5/2001 Fowle ..... A63C 17/06 280/11.115

(Continued)

OTHER PUBLICATIONS

Ismet Handiz, "Design and Testing of a Motion Controlled Gati Enhancing Mobile Shoe (GEMS) for Rehabilitation", pp. 1-110, Mar. 22, 2011.

(Continued)

*Primary Examiner* — Brodie Follman
*Assistant Examiner* — Brian Cassidy
(74) *Attorney, Agent, or Firm* — Thomas | Horstemeyer, LLP

(57) ABSTRACT

In one embodiment, a gait-altering shoe includes a frame adapted to support a user's foot and at least one wheel that supports the frame above a walking surface, the wheel having a radius that varies as a function of angular position of the wheel.

25 Claims, 9 Drawing Sheets

(56) References Cited

U.S. PATENT DOCUMENTS 6,689,075 B2 * 2/2004 West ..... A61F 5/0102 482/69
6,811,523 B1 * 11/2004 Timmer ..... A63B 21/0004 482/146
6,836,744 B1 * 12/2004 Asphahani ..... A43D 1/02 377/24.2
6,882,955 B1 * 4/2005 Ohlenbusch ..... A43B 3/0005 324/160
7,150,722 B1 12/2006 Tyrrell
7,153,242 B2 12/2006 Goffer
7,367,569 B2 * 5/2008 Viitamaki ..... A63C 17/12 280/11.115
7,383,908 B2 * 6/2008 Tuli ..... A43B 3/0005 180/181
7,422,550 B1 * 9/2008 Pinero ..... A61H 3/008 135/65
7,552,021 B2 * 6/2009 Bar-Haim ..... A61B 5/1038 602/36
7,632,239 B2 * 12/2009 Dar ..... A61B 5/6807 600/587
7,648,472 B2 * 1/2010 McCarthy ..... A61F 5/0111 128/882
7,938,756 B2 5/2011 Rodetsky et al.
7,988,647 B2 * 8/2011 Bunn ..... A61B 5/1038 600/587
8,006,795 B2 * 8/2011 Manor ..... A43B 3/0005 180/181
8,052,629 B2 11/2011 Smith et al.
8,142,381 B1 * 3/2012 Birnbaum ..... A43B 7/141 128/882
8,209,147 B2 * 6/2012 Solinsky ..... G01C 21/005 235/105
8,413,998 B2 * 4/2013 Sano ..... A63C 17/0066 280/11.222
8,613,691 B2 * 12/2013 Bosecker ..... A61H 1/005 482/54
9,027,690 B2 * 5/2015 Chavand ..... A63C 17/12 180/181
9,180,025 B2 * 11/2015 Goldfarb ..... A61F 2/60
2004/0154192 A1 * 8/2004 Bengtsson ..... A43B 7/1415 36/30 R
2005/0261609 A1 11/2005 Collings
2011/0257764 A1 11/2005 Collings
2006/0247104 A1 * 11/2006 Grabiner ..... A63B 22/0292 482/54
2006/0249315 A1 * 11/2006 Herr ..... A61F 2/60 180/8.1
2007/0130804 A1 * 6/2007 Levy ..... A43B 1/0027 36/136
2007/0275830 A1 * 11/2007 Lee ..... A61B 5/1038 482/54
2008/0134541 A1 * 6/2008 Bar-Haim ..... A61B 5/1038 36/27
2008/0146968 A1 * 6/2008 Hanawaka ..... A61B 5/1038 600/595
2010/0038983 A1 * 2/2010 Bhugra ..... A61F 2/68 310/83
2010/0076360 A1 3/2010 Shimada
2010/0268129 A1 * 10/2010 Park ..... A61H 1/0237 601/35
2010/0298102 A1 * 11/2010 Bosecker ..... A61H 1/005 482/54
2011/0208444 A1 * 8/2011 Solinsky ..... A61B 5/112 702/41
2013/0197407 A1 * 8/2013 Flythe, Jr. ..... A61H 1/0262 601/34
2014/0162858 A1 * 6/2014 Dalebout ..... A63B 23/02 482/142
2014/0262576 A1 * 9/2014 Tuli ..... A43B 3/0005 180/167

OTHER PUBLICATIONS

Groot, et al. "Gait Enhancing Mobile Shoe (GEMS) for Rehabilitation", Third Joint Eurohaptics Conference and Symposium on Haptic Interfaces for Virtual Environment and Teleoperator Systems, Mar. 18-20, 2009.

II. Handzic, E. Vasudevan, and K B. Reed, "Motion Controlled Gait Enhancing Mobile Shoe for Rehabilitation," Proc. of the 12th Intl. Conf. on Rehabilitation Robotics (ICORR), Zurich, Switzerland, Jun. 2011.

Handzic, et al., Design and Pilot Study of a Gait Enhancing Mobile Shoe, SpringerLink, Dec. 2011, vol. 2, Issue 4, pp. 193-201.

* cited by examiner

GAIT-ALTERING SHOES

CROSS-REFERENCE TO RELATED APPLICATION

This application claims priority to U.S. Provisional Application Ser. No. 61/600,267, filed Feb. 17, 2012, which is hereby incorporated by reference herein in its entirety.

NOTICE OF GOVERNMENT-SPONSORED RESEARCH

This invention was made with Government support under grant 1 R21 HD066200-01, awarded by the National Institutes of Health. The Government has certain rights in the invention.

BACKGROUND

Asymmetric gait is sometimes developed in individuals with central nervous system damage, such as stroke, or in persons who have suffered damage to the spinal cord, brainstem, cerebellum, or motor cortex. In such cases, a limp is developed and the person does not fully extend his foot far enough backward, which can prevent him from effectively pushing off into the swing phase of his gait.

In such cases, rehabilitation is often provided using a split-belt treadmill having two independent belts that can be operated at different speeds to exaggerate the asymmetry of the person's gait. In particular, the belt associated with the weak leg can be driven faster than the belt associated with the strong leg. An adaptation process occurs during such rehabilitation such that, once the belts are operated at the same speed, an altered walking pattern is retained as an after-effect.

Continuous and repeated split-belt gait training has been found to temporarily restore a normal walking pattern. However, individuals with such corrected walking patterns typically only retain them for a short period of time and the gait pattern often does not transfer to walking over a normal walking surface, such as the floor or ground. Because the adaptation effects only last for a short period of time, the effects of long-term training are still unknown.

In view of the above discussion, it can be appreciated that it would be desirable to have a way to provide rehabilitation to persons with asymmetric gait other than using split-belt treadmill therapy.

BRIEF DESCRIPTION OF THE DRAWINGS

The present disclosure may be better understood with reference to the following figures. Matching reference numerals designate corresponding parts throughout the figures, which are not necessarily drawn to scale.

DETAILED DESCRIPTION

As described above, it would be desirable to have a way to provide rehabilitation to persons with asymmetric gait other than using split-belt treadmill therapy. Disclosed herein are gait-altering shoes that, at least in some cases, provide similar rehabilitation to the person but without limiting him or her to walking on a treadmill. In some embodiments, the shoes transform the downward force of a user's weight into a force that shifts the user's foot backward to exaggerate the user's asymmetric gait. As with a split-belt treadmill, this forces the user to put forth greater effort with his or her weak leg and helps restore normal function. In some embodiments, the gait-altering shoe includes wheels having a varying radius that automatically rotate backward under the weight of the user. In some embodiments, one or more springs are used to return the wheels to their original positions when the user lifts his or her foot and one or more dampers are used to control the backward rotation of the wheels.

Figure 1:
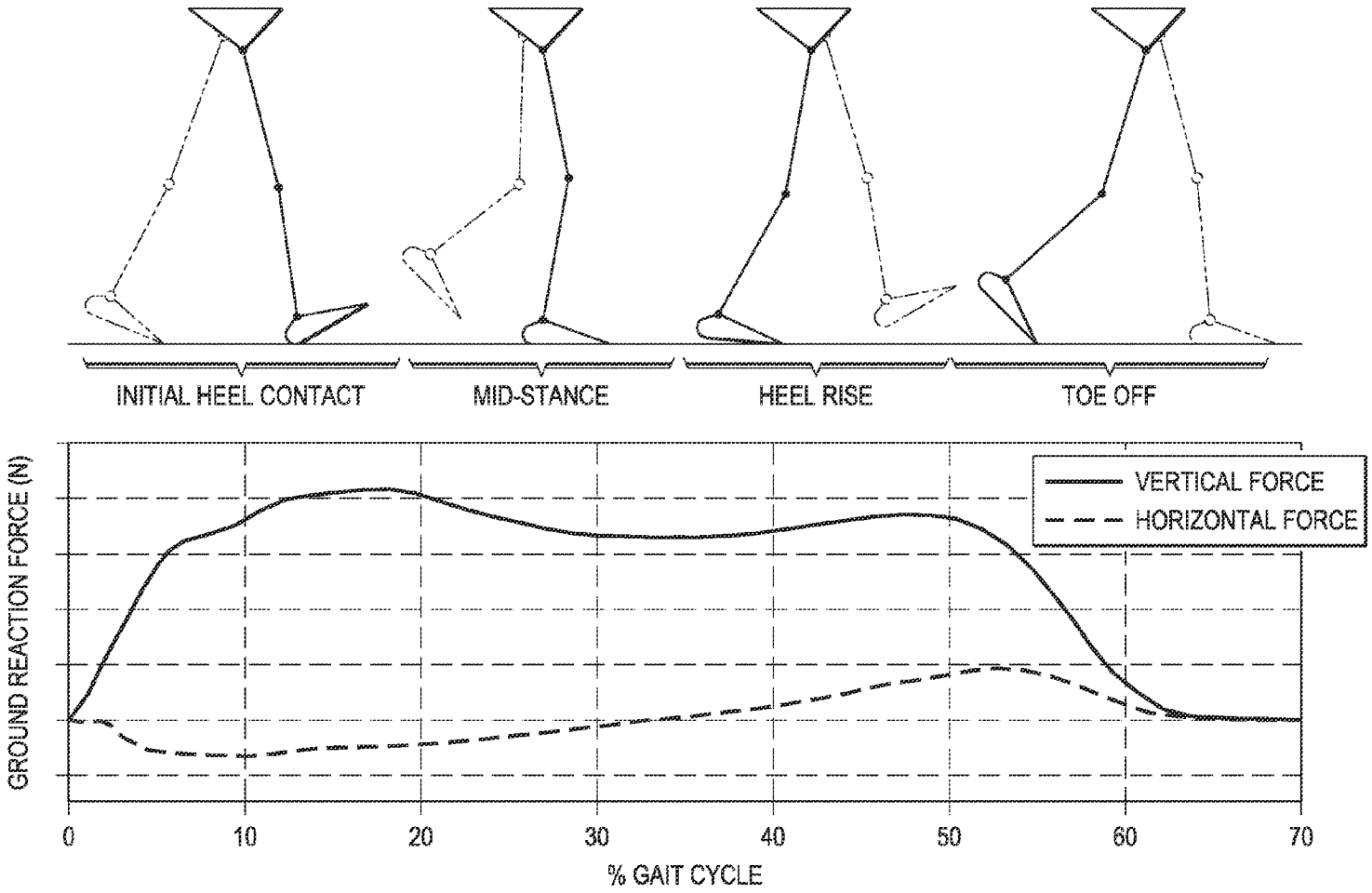
FIG. 1 (PRIOR ART)
FIG. 1 is a schematic of the normal human gait cycle matched with a graph that identifies vertical and horizontal forces applied to a walking surface throughout the gait cycle.

Because this disclosure pertains to altering a user's gait, it is worthwhile to review the basics of a normal human gait pattern. The gait cycle can be divided into two distinct phases: the stance phase, in which the user applies weight to the walking surface, and the swing phase, in which the user swings the leg forward to take the next step. As is shown in FIG. 1, the stance phase is preceded by initial heel contact at which time the heel first contacts the walking surface. By mid-stance, all of the user's weight is transferred to the foot. The end of the stance phase begins with the user lifting the heel of the foot (i.e., heel rise) to prepare for weight transfer to the other foot, which has been swung forward. Heel rise is then followed by toe off at which point the user pushes off with his or her foot. Stroke victims often have similar gaits but can exhibit slightly different gait patterns. The forward propulsive force is typically smaller in such persons. In addition, many stroke victims place their feet in plantar flexion, which causes a toe first step pattern and supination such that more weight is applied to the lateral side of the foot.

FIG. 1 further includes a graph that illustrates the horizontal and vertical forces that are applied by the foot during phases of the gate cycle described above. As is apparent from the graph, a slightly variable vertical force is applied during the stance phase. At a point that equates to 33% of the full gait cycle, the horizontal reaction force switches from accelerating the body backward to accelerating the body forward.

The concept of context awareness is an important consideration when altering a user's gait. Context awareness is the user's ability to unconsciously anticipate the environment while preparing for disturbances. This can be witnessed in situations in which a person relies upon visual cues, such as stepping onto a non-operating escalator. In particular, as an individual approaches the escalator, the individual will automatically prepare to engage the escalator by leaning forward. If the escalator is not moving, however, the person may become unbalanced. This occurs because the body's internal model expects that forward lean is necessary when getting on the escalator because of the individual's many previous interactions with it, but the person stumbles because there is no acceleration from the non-moving escalator. Context awareness provides evidence of visual exteroception and the role it plays in the conditioning of the human gait and gait adaptation process in hemiplegic patients.

It is this context awareness that is hypothesized to be an integrating factor in the inability to store the previously-described feed-forward motion learned in split-belt gait manipulation research. While after-effects can be achieved, the learned gait motion disappears quickly once subjects adapt to the asymmetric treadmill speed and subsequently walk over a normal walking surface, such as the floor or ground. This may occur because the visual cues perceived while walking on a treadmill are very different from those perceived while walking over the floor or ground.

If the person's gait could be adjusted in the natural context of walking (as opposed to the context of walking on a treadmill), the problem of context awareness during the gait adaptation process would be removed. In such a case, there would be no disconnect between the visual cues perceived during the conditioning process and the visual cues perceived during the adaptation process. This suggests that gait should be adjusted with an apparatus that can be used in the natural walking context. One such apparatus is a gait-altering shoe. As is described below, a gait-altering shoe can be used to passively convert the vertical force of the user during the stance phase and redirect it into a backward motion as would a moving belt of a treadmill. Unlike when a treadmill is used, however, the backward motion is provided in the natural walking context.

FIGS. 2-5 illustrate an example embodiment of a gait-altering shoe 10. As shown in those figures, the shoe 10 generally comprises a frame 11 that includes a front portion 12 that can be associated with the front part of a user's foot and a rear portion 14 that can be associated with a rear part of the user's foot. More particularly, the front portion 12 is adapted to span from the ball of the foot to the toes while the rear portion 14 is adapted to span from the ball of the foot to the heel.

In the illustrated embodiment, the front portion 12 of the frame 11 is defined by a base 16, lateral sides 18, and a top platform 20. Although the base 16, sides 18, and platform 20 are shown in the figures as being separate components, it is noted that one or more of these components can be unitarily formed from the same piece of material. In some embodiments, the components are made of a polymeric or lightweight metal material. Irrespective of the construction of the front portion 12, the platform 20 is sized and configured so as to extend across an area that is slightly greater than that of the front part of the user's foot. In some embodiments, the platform 20 can have a width of approximately 2.5 to 5 inches and a length of approximately 2 to 6 inches.

The rear portion 14 of the frame 11 is defined by a base 22, lateral sides 24, and a top platform 26. Although the base 22, sides 24, and platform 26 are shown in the figures as being separate components, it is noted that one or more of these components can also be unitarily formed from the same piece of material. In some embodiments, the components are made of a polymeric or lightweight metal material. Irrespective of the construction of the rear portion 14, the platform 26 is sized so as to span an area that is slightly greater than that of the rear part of the user's foot. In some embodiments, the platform 26 can have a width of approximately 2.5 to 5 inches and a length of approximately 6 to 10 inches.

Figure 4:
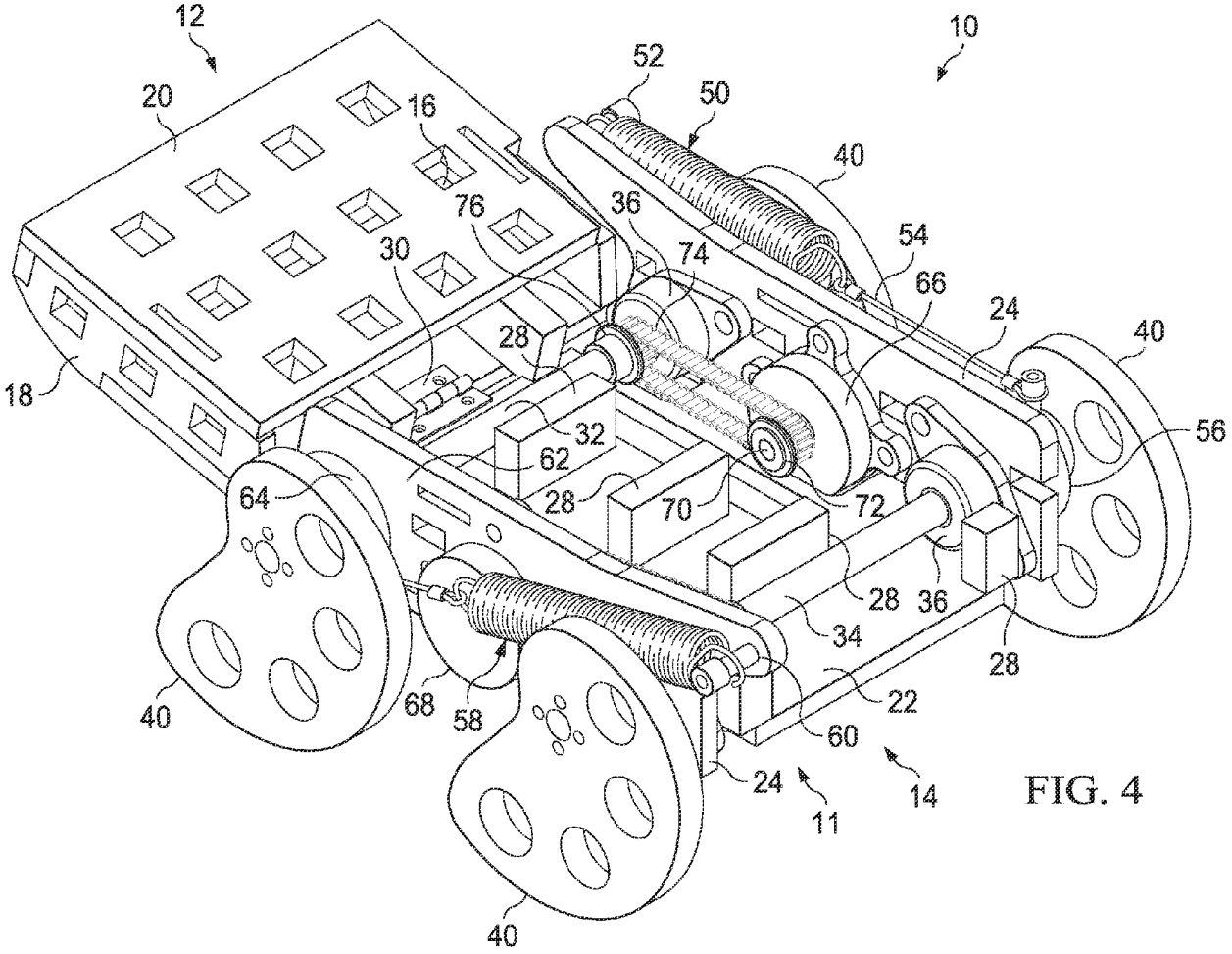
FIG. 4 is a top perspective view of the gait-altering shoe of FIG. 2 illustrating internal components of the shoe.
Figure 5:
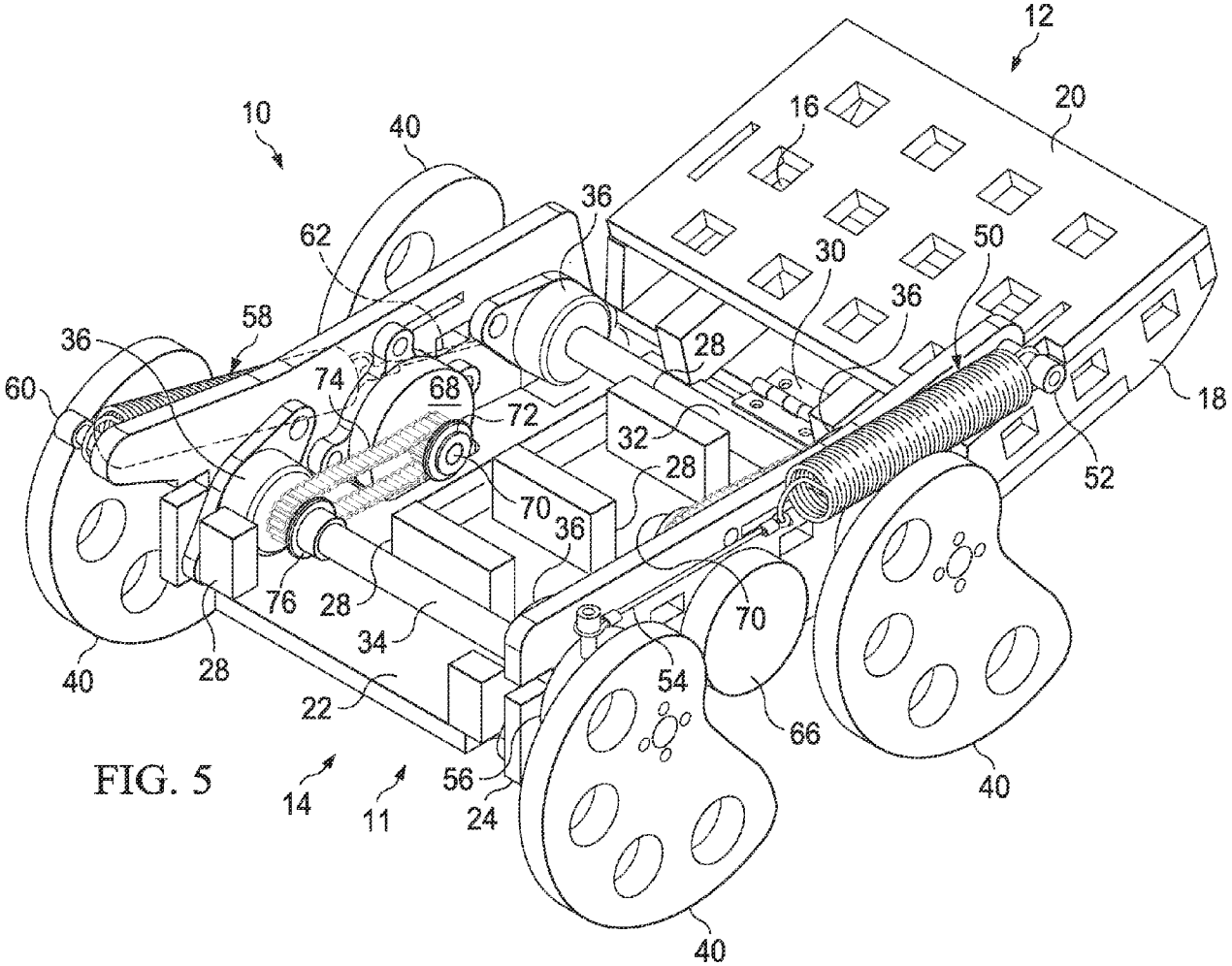
FIG. 5 is a further top perspective view of the gait-altering shoe of FIG. 2 illustrating internal components of the shoe.

FIGS. 4 and 5 illustrate the gait-altering shoe 10 with the top platform 26 of the rear portion 14 of the frame 11 removed. As is apparent from those figures, the rear portion 14 further includes spacers 28 that are positioned between the base 22 and the platform 26 to provide support to the platform to which the user's weight is applied. In some embodiments, the spacers 28 are unitarily formed with the base 22.

As is further apparent from FIGS. 4 and 5, the front portion 12 of the frame 11 is pivotally mounted to the rear portion 14 of the frame. More particularly, the base 16 of the front portion 12 is pivotally mounted to the base 22 of the rear portion 14 with the hinge 30. With such a configuration, the front portion 12 can pivot relative to the rear portion 14 in a similar manner to the way in which the front part of the foot pivots relative to the rear part of the foot during the push-off phase of the gait cycle.

With further reference to FIGS. 4 and 5, the rear portion 14 of the frame 11 supports a front axle 32 and a rear axle 34 that are perpendicular to the length direction of the frame. By way of example, the axles 32, 34 are made of a metal material, such as steel. In the illustrated embodiment, the axles 32, 34 are mounted to the rear portion 14 with bearings 36 that are attached to the inner surfaces of the lateral sides 24. As is further shown in FIGS. 4 and 5, the axles 32, 34 extend through the bearings 36 and the lateral sides 24 of the rear portion 14 so as to extend out from opposite sides of the rear portion.

Figure 6:
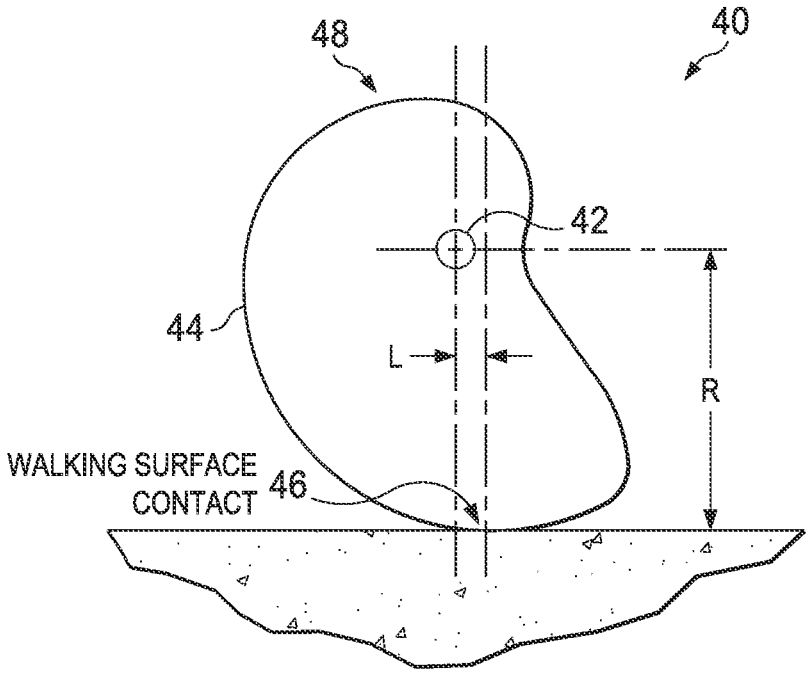
FIG. 6 is a schematic view of an embodiment of a wheel that can be used on a gait-altering shoe.

Fixedly mounted to each end of the axles 32, 34 is a wheel 40. Together, the four wheels 40 support the gait-altering shoe 10 above a walking surface, such as the floor or ground. FIG. 6 shows an example embodiment for the wheels 40. As shown in that figure, the wheels 40 comprise a mounting opening 42 through which an associated axle can pass and a curved outer surface 44 that can make contact with the walking surface. As is apparent from FIG. 6, the distance between the center of the opening 42 and the outer surface 44 (i.e., the radius, R, of the wheel 40) varies as a function of the angular position along the wheel. In some embodiments, the outer surface 44 follows the Archimedean spiral such that the slope of the surface in polar coordinates is constant. With such a shape, the distance between the opening 42 and the outer surface 44 is much greater at a bottom 46 of the wheel 40, where the wheel initially contacts the walking surface, than at a top 48 of the wheel, which later comes into contact with the walking surface once the user applies his or her weight to the shoe 10. As is further shown in FIG. 6, the opening 42 can be offset from the point at which the wheel 40 initially contacts the walking surface by a distance, L.

Figure 7:
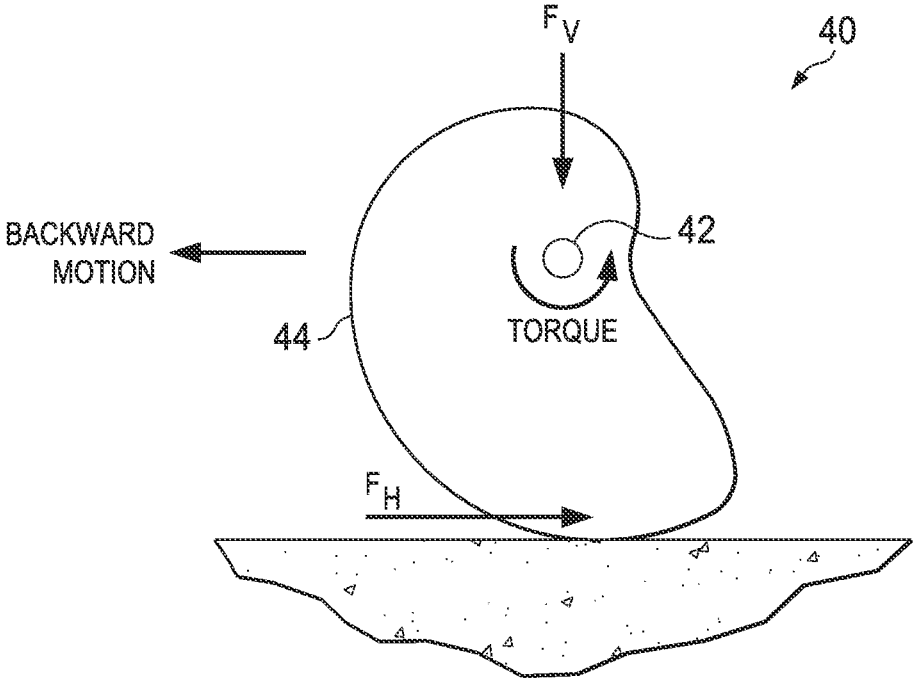
FIG. 7 is a schematic view of the wheel of FIG. 6 illustrating movement of the wheel as well as forces that are applied to the wheel during such movement.

The above-described wheel shape is an important aspect of the gait-altering shoe design. When the wheel 40 is attached to an axle, its spiral shape redirects the wearer's downward force $F_V$ during the stance phase into a horizontal backward motion, as shown in FIG. 7. This resulting motion is similar to a circular wheel rolling down a hill except that the slope is attached to the foot. The shape of the wheel and the generated horizontal force $F_H$ are determined by the following equations. The equations can also be used to determine the shape of the wheel needed to generate a specific horizontal force:

$$R(\theta) = b\theta^{\frac{1}{n}} \quad (1)$$

$$F_{H,avg} = \frac{1}{R_2 - R_1}\int_{R_1}^{R_2} F_H(R)\,dr \quad (2)$$

$$F_H = F_V * \left(\frac{L}{R}\right) \quad (3)$$

Assuming a linear increase in the size of the wheel (n=1), changing the slope at different points along the outer surface of the wheel enables optimization of the force generated at each instant of the stance phase because the relationship is based on the slope of the wheel in polar coordinates. In some embodiments, the largest radius of the wheel is approximately 2.75 inches (7.0 cm), the shortest radius is approximately 1.0 inches (2.54 cm), and n=1 so that the wheels generate an average horizontal backward force of 36 pounds (160 N) assuming an 800 pound (180 N) vertical downward force from the user.

In some embodiments, the outer surfaces 44 of the wheels 40 can be coated with a high-friction coating, such as a rubber or polymeric coating, to ensure that the wheel does not slip on the walking surface to which it is applied. Such a coating can further absorb some of the initial force transmitted to the shoe 10 when the wheel 40 first comes into contact with the walking surface.

With reference again to FIGS. 2-5, the rear portion 14 of the gait-altering shoe 10 further includes biasing elements that return the wheels 40 to their original positions after they have rotated during use. In the illustrated embodiment, the biasing elements comprise a right-side spring 50 that affects the rear axle 34 and a left-side spring 58 that affects the front axle 32. As is shown in the figures, the right-side spring 50 is connected at one end to a mounting peg 52 located at a front, right end of the rear portion 14 of the frame 11. The other end of the spring 50 is connected to a cable 54 that extends rearward from the spring and attaches to a pulley 56 that is fixedly mounted to the rear axle 34. The left-side spring 58 is connected at one end to a mounting peg 60 located at a rear, left end of the rear portion 14 of the frame 11. The other end of the spring 58 is connected to a further cable 62 that extends forward from the spring and attaches to a pulley 64 that is fixedly mounted to the front axle 32. Although the springs 50, 58 are shown positioned outside of the rear portion 14 of the frame 11, it is noted that they can, in some embodiments, be positioned inside the rear portion. Moreover, while a particular configuration of the springs, cables, and pulleys is shown in the figures, it is noted that other configurations are possible. The particular nature of the configuration is less important than the functionality that is provided (i.e., returning the wheels 40 to their original positions).

When the rear wheels 40 rotate backward, for example, during the stance phase of the gait cycle, the rear axle 34 and pulley 56 likewise rotate backward. When this occurs, the cable 54 is pulled toward the rear of the rear portion 14 and the spring 50 is stretched. As the heel is lifted and the force of the user's weight is removed, however, the spring 50 pulls on the cable 54 causing the pulley 56 to rotate forward, thereby returning the rear wheels 40 to their initial positions. When the front wheels 40 rotate backward, for example, during the stance phase of the gait cycle, the front axle 32 and pulley 64 likewise rotate backward. When this occurs, the cable 62 is pulled forward and the spring 58 is stretched. As the foot is lifted and the force of the user's weight is removed, however, the spring 58 pulls on the cable 62, causing the pulley 64 to rotate forward, thereby returning the front wheels 40 to their initial positions.

With particular reference to FIGS. 4 and 5, the rear portion 14 of the gait-altering shoe 10 can further comprise damping elements that control rotation of the wheels 40 when force is applied to them. In the illustrated embodiment, the damping elements comprise unidirectional dampers 66 and 68 that are mounted to the lateral sides 24 of the rear portion 14 of the frame 11. Each damper 66, 68 includes an inwardly extending shaft 70 on which is mounted a sprocket 72. The sprockets 72 engage chains 74 that are respectively coupled to the front and rear axles 32, 34. Specifically, the chain 74 coupled to the right-side damper 66 is coupled to the front axle 32 with a sprocket 76 and the left-side damper 68 is coupled to the rear axle 34 with another sprocket 76. Although chains and sprockets are illustrated in the figures and have been described, it is noted that other linkage components that provide the same function can be used. For example, rubber or polymeric belts can be used in lieu of chains.

During use, the dampers 66, 68 limit the rotation speed of the wheels 40 and prevent a jerky motion when the user steps on the gait-altering shoe 10. Because the dampers 66, 68 are unidirectional, they do not limit the speed of forward rotation of the wheels 40 and therefore enable the wheels to quickly return to their initial positions. In some embodiments, the dampers 66, 68 provide approximately 17 lb-in (1.9 N-m) of torque per axle. That amount of torque is adequate for a 180 pound (82 kg) user, but works for a range of 150 pounds (68 kg) to 190 pounds (86 kg) and can be adjusted as needed for other wearers.

Figure 2:
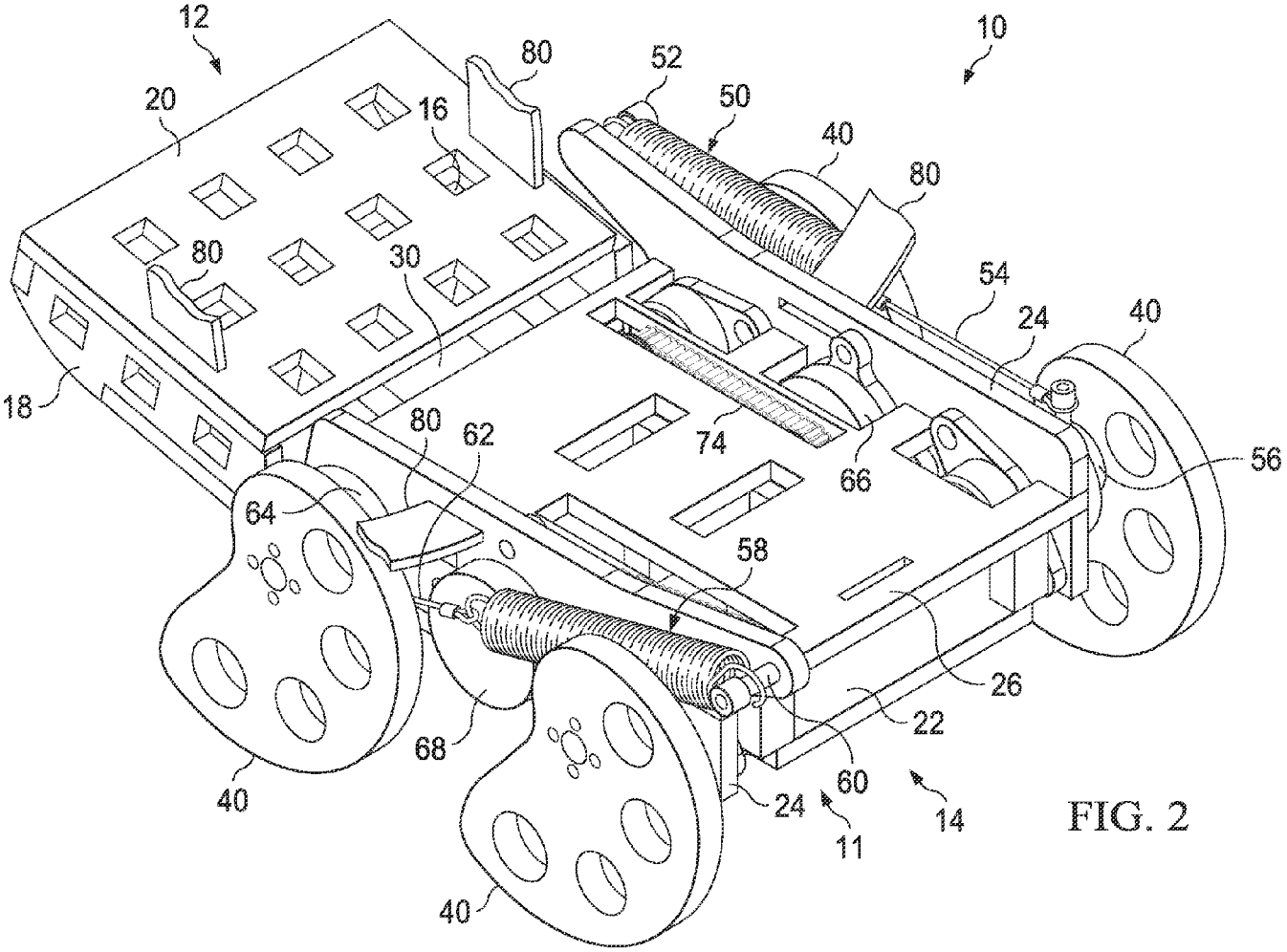
FIG. 2 is a top perspective view of an embodiment of a gait-altering shoe.
Figure 3:
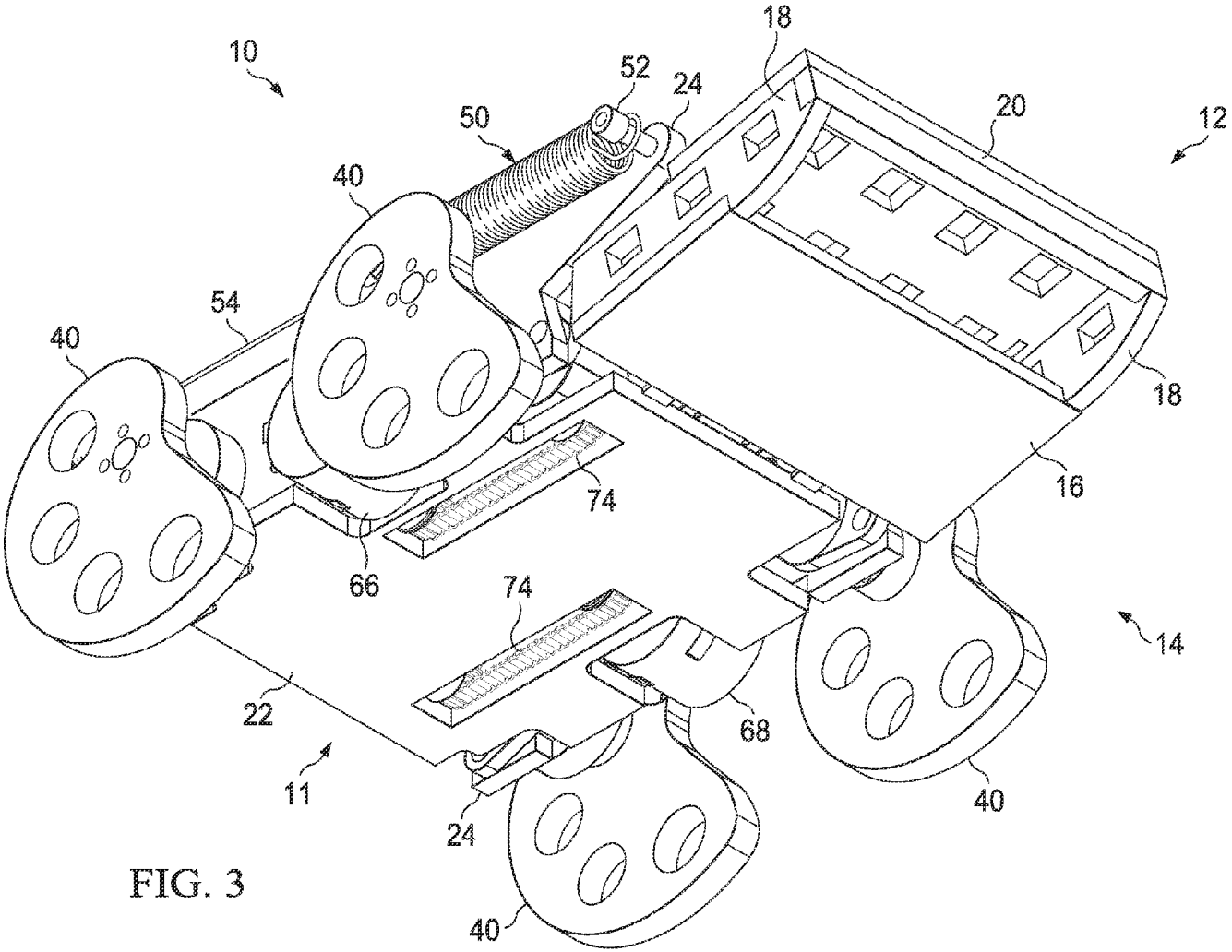
FIG. 3 is a bottom perspective view of the gait-altering shoe of FIG. 2.
Figure 8:
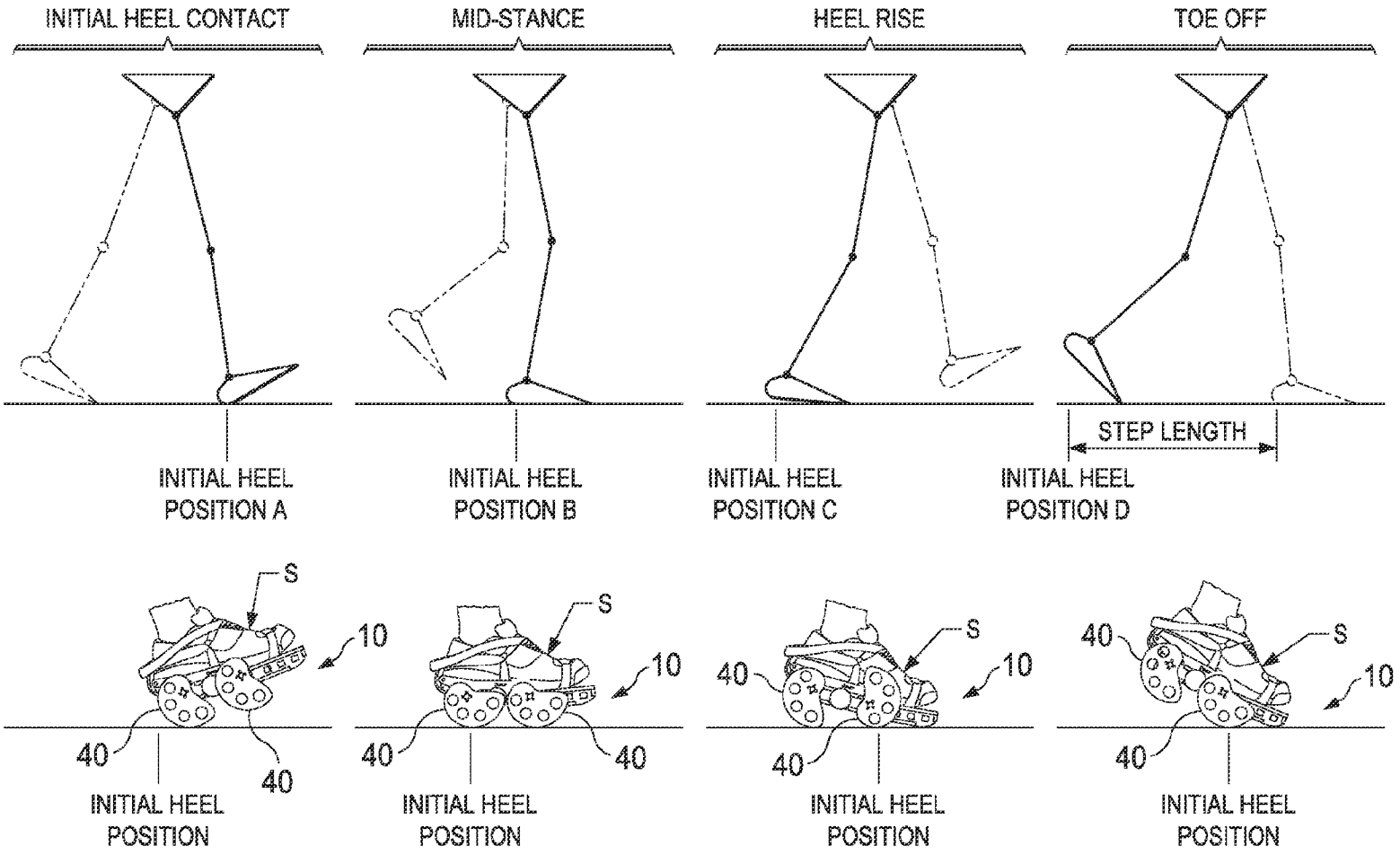
FIG. 8 is a schematic of the normal human gait cycle matched with sequential views of the gait-altering shoe of FIG. 2 during the various phases of the gait cycle.

As is further shown in FIG. 2, the gait-altering shoe 10 can further comprise multiple securing straps 80 that can be used to secure the shoe to a user's foot or a normal shoe that is present on the user's foot (see FIG. 8). In some embodiments, the straps 80 include a toe strap, a mid-foot strap, and a heel strap.

FIG. 8 comprises sequential images of the gait-altering shoe 10 during the various phases of the gait cycle. As is shown in FIG. 8, the shoe 10 has been attached to an exercise shoe S worn by a user. In some embodiments, the gait-altering shoe 10 can be worn on the foot of the weak leg and an equivalent height and weight shoe or walking platform (not shown) can be worn on the other foot.

In image A of FIG. 8, which illustrates initial heel contact, the rear wheels 40 of the gait-altering shoe 10 have made contact with the floor after the user has taken a step. By way of example, the bottom of the user's shoe S is approximately 3.5 inches above the floor surface when the user first initiates heel contact. The point on the floor at which initial contact was made by the rear wheels 40 is indicated in image A, as well as in images B-D. Because the user has begun to apply his weight to the shoe 10, the rear wheels 40 have rotated about the rear axle 34.

In image B, which illustrates the mid-stance phase, the user has placed all of his weight on the gait-altering shoe 10. As a result, all of the wheels 40 have rotated about their axles. By way of example, the bottom of the user's shoe S is approximately 1.5 inches above the floor surface at this point. Because of the variable radiuses of the wheels 40, this rotation has caused the shoe 10 and the user's foot to move backward from the initial contact point.

In image C, the user has begun to raise his heel and the rear wheels 40 have rotated forward under the force of the spring 50 (see FIG. 2). Because the user's weight has transferred to the ball of the user's foot, however, the front wheels 40 have continued to rotate backward. As can be appreciated from image C, this has resulted in even further backward motion of the shoe 10. By way of example, the shoe 10 can have moved the foot up to approximately 12 inches backward at this point in the gait cycle.

In image D, which shows the toe-off phase, the user is about to lift his foot off of the floor. As is apparent from that image, the rear wheels 40 no longer touch the floor and have moved closer toward their original positions because of the spring 50. In addition, the front wheels 40 have begun to return to their original positions under the force of the spring 58 (see FIG. 2).

The therapy that the above-described gait-altering shoe provides differs significantly from that of split-belt treadmills. While the body's velocity relative to the walking surface is zero on a split-belt treadmill, the relative velocity of the gait-altering shoe is non-zero and forward. The gait-altering shoe forces the wearer's foot backward whereas the stationary foot has a zero velocity relative to the walking surface. It is anticipated that prolonged use of the gait-altering shoe will yield positive after-effects in individuals with asymmetric gait and enable those individuals to develop a more persistent symmetric gait. Training an individual with the gait-altering shoe may also strengthen muscles due to the different walking pattern that is developed, which in turn could alter the individual's gait.

Testing was performed to evaluate the effectiveness of a gait-altering shoe having a construction similar to that described above. The testing involved three subjects who were all university student males, ages 20-25, with normal walking patterns. All three subjects were measured on their baseline walking pattern before walking on the gait-altering shoe. Temporal and spatial variables of gait were evaluated using the GAITRite Walkway System (CIR Systems, Inc., PA), which is a 2-foot (0.6 m) by 16-foot (4.9 m) walkway comprising pressure sensors that are able to accurately monitor each step position. The testing emphasized the change in step length between the baseline and immediately post-training.

For the baseline measurement, each subject walked on the GAITRite Walkway System five separate times. The average step length of all five trials was recorded and later compared to post-training step length. The baseline readings were analyzed for any initial asymmetry of the subject's gait before the gait-altering shoe was strapped to the foot with the shorter step length (if present). This was done because an individual with an asymmetric gait, such as a stroke patient, would have a shorter step length on the hemiplegic side. Accordingly, the gait-altering shoe was attached to the "hemiplegic" leg of the healthy subject in order to increase the step length although the asymmetry was very small or nonexistent. In order to compensate for the height and weight of the gait-altering shoe, the subjects wore an adjustable platform on the other foot.

Each of the subjects walked back and forth on a 48-foot (14.6 m) thin carpet walkway for approximately 20 minutes. The thin carpet was used in order to increase the friction between the smooth wheels and the floor. The subjects were observed during the training and were encouraged to take normal heel-to-toe steps in order to keep a consistent gait. After 20 minutes of gait training on the gait-altering shoe, the subject was seated in a rolling chair and the gait-altering shoe and support platform were removed. The subject was then rolled to the GAITRite Walkway System in order to capture the initial steps. The subject proceeded to walk five separate times on the walkway system and each trial was recorded for later comparison to the average baseline step length.

A retention test was also performed in order to determine if any after-effects persisted over a longer time period. This was achieved by enabling the subject to walk around for 10 additional minutes at a comfortable pace without stopping. After the subject walked 10 minutes, the subject walked on the GAITRite mat five more times and an average retention step length was recorded for later analysis.

In pretesting, the gait-altering shoe pushed the user's foot back an average of 7 inches (17.8 cm) in a continuous, steady, and smooth motion. Because of its deformability, the shoe enabled the user to toe off correctly for a smooth transition into the swing phase. Every step was consistent and there was little variation, much like a split-belt treadmill. This low variation from step to step was important because it was a goal of the study to mimic the motion of a split-belt treadmill.

As mentioned above, the gait-altering shoe closely mimics a split-belt treadmill. However, unlike the split-belt treadmill, which has a tread speed ratio of 2:1, the tested gait-altering shoe had a foot speed ratio of 4:3.

Figure 9:
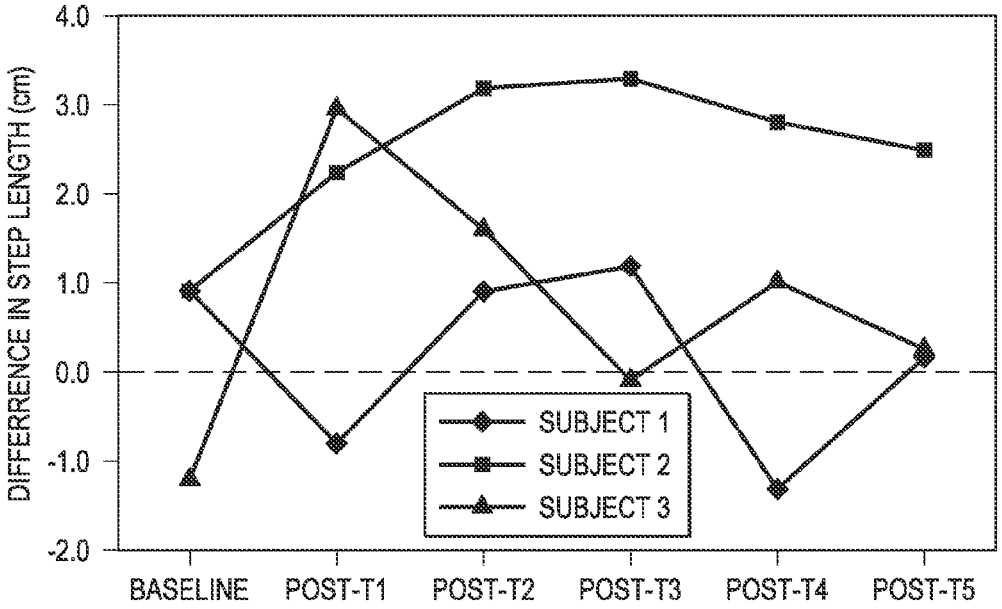
FIG. 9 is a graph that plots differences in step length between the left and right feet for test subjects walking without a gait-altering shoe after having walked with a gait-altering shoe.

The differences in step length between the foot with the gait-altering shoe and the other foot are shown in FIG. 9 for the baseline average, post-training five trials of walking 16 feet (4.9 m), and retention average. Two out of the three subjects (Subjects 2 and 3) showed an increase in the asymmetry in the expected direction. Specifically, the leg that wore the shoe developed a longer step length in the post-training trials. This implies that adaptation was created in the gait patterns. The subject who had the opposite pattern also had the highest variability in step symmetry during baseline and retention testing, so there may be other effects affecting this subject's adaptation. The post-training average step length difference for Subjects 2 and 3 increased by 0.67 inches (1.72 cm) and 0.94 inches (2.38 cm), respectively. For both Subjects 2 and 3, the retention after a 10-minute walking period was negligible, which can be expected in healthy subjects.

Test Subject 1 showed no average difference in step length increase, but rather a slight decrease of 0.36 inches (0.92 cm) in the reverse direction. It is apparent from FIG. 10 that the post-training step length difference fluctuated around zero. The results for Subject 1 are interesting because they show that the average retention difference in step length has a magnitude of 1.10 inches (2.77 cm) from baseline average in the reverse direction from the other two subjects. This deviation can possibly be explained by the walking style of Subject 1. While Subjects 2 and 3 comfortably walked in a correct gait when wearing the gait-altering shoe, Subject 1 swung the leg with the gait-altering shoe around the side to compensate for the loss in step length, thus conditioning separate leg muscles. This indicates that training may be dependent upon the user walking with his or her typical gait.

Figure 10:
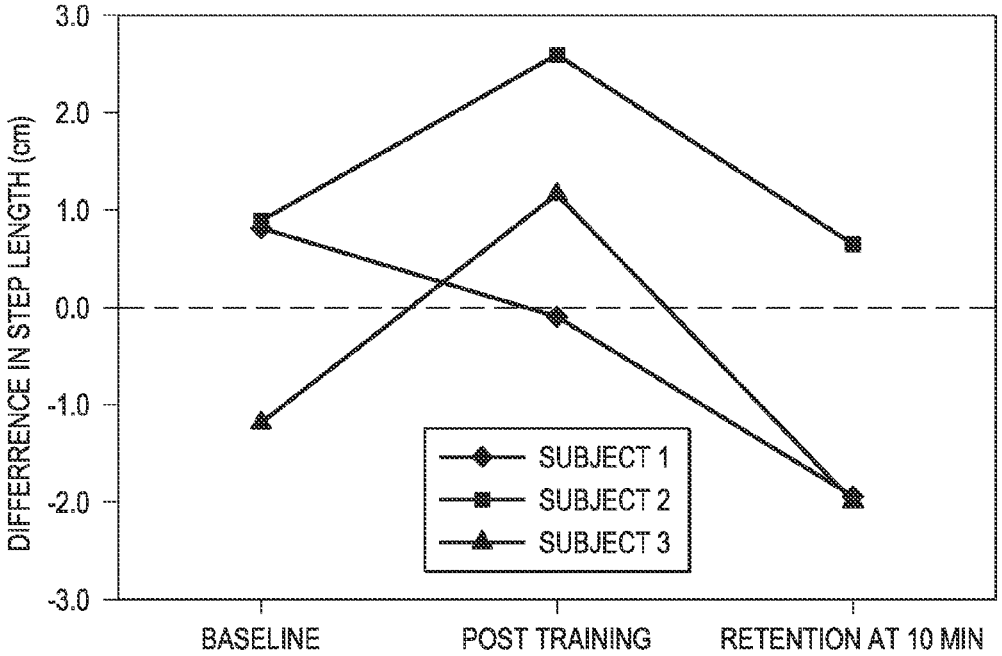
FIG. 10 is a graph that plots the average and retention differences in step length between the left and right feet for test subjects after training with a gait-altering shoe.

The baseline average and all five post-training trials are shown in FIG. 10. Again, test Subjects 2 and 3 show post training after-effects. Compared to their baseline difference in step length, these after-effects are very strong in Subjects 2 and 3, although with slight differences. Subject 2 kept the after-effect over all five post-training trials, whereas Subject 3 diminishes some of the after-effect at trial 3, regains some at trial 4, and then diminishes again at trial 5.

Figure 11:
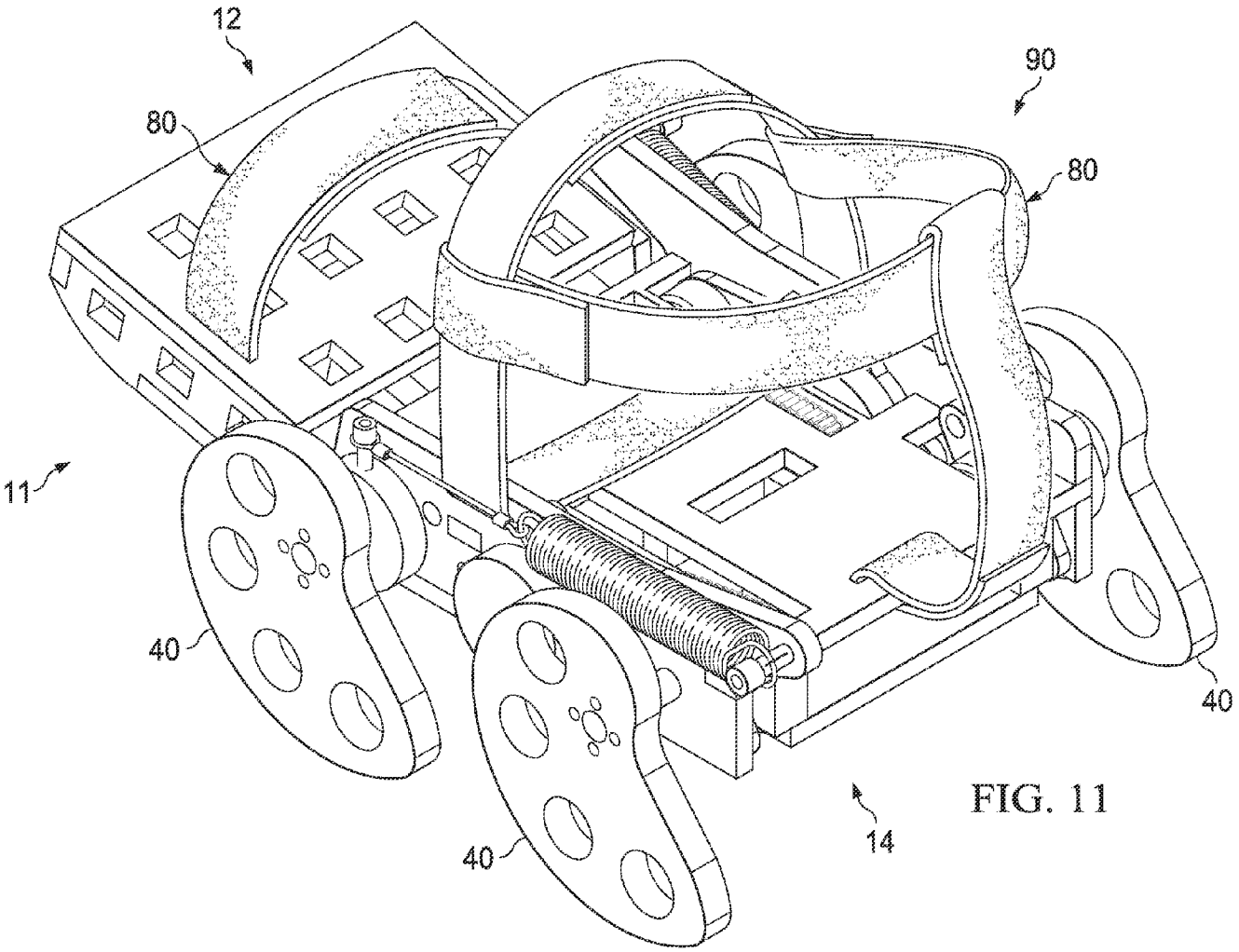
FIG. 11 is a top perspective view of a further embodiment of a gait-altering shoe.

Various modifications can be made to the disclosed gait-altering shoe without materially changing its underlying functionality. For example, although the front and rear axles have been illustrated and described as being independent of each other, they can be coupled together with a linkage (e.g., a chain or belt) so that they rotate in unison. In such a case, a single spring can be used to return all of the wheels to their original positions and/or a single damper can be used to control rotation of all wheels during the stance phase of the gait cycle. In other embodiments, the direction in which the wheels rotate can be reversed so that the shoe propels the foot forward instead of moving it backward. FIG. 11 provides an example of such an embodiment.

FIG. 11 illustrates an embodiment of a gait-altering shoe 90 that provides forward propulsion. As is apparent from FIG. 11, the shoe 90 is similar in many ways to the shoe 10. Accordingly, the shoe 90 comprises a frame 11 having a front portion 12 adapted to span from the ball of the foot to the toes and a rear portion 14 adapted to span from the ball of the foot to the heel. The rear portion 14 of the frame 11 supports a front axle 32 and a rear axle 34 to which are mounted wheels 40. However, in the embodiment of FIG. 11, the wheels 40 are reversed from the orientations shown in FIGS. 2-5 such that the wheels tend to rotate forward instead of backward when weight is applied to the shoe 90. The remainder of the shoe 90 can be substantially identical to that of the shoe 10, although the springs and dampers operate in opposite directions to return the wheels 40 to their original positions and control forward rotation of the wheels.

In some cases, a gait-altering shoe 10 can be worn on one foot and a gait-altering shoe 90 can worn on the other foot to further exaggerate the gait asymmetry and generate the greatest motion differential between the feet. In other cases, a gait-altering shoe 90 can be worn on each foot to propel both feet forward during ambulation. In still further cases, a gait-altering shoe 10 can be worn on each foot to displace each foot backward to provide exercise.

The invention claimed is:

1. A gait-altering shoe comprising:

a frame adapted to support a user's foot; and at least one wheel that supports the frame above a walking surface, the wheel having a radius that varies as a function of angular position of the wheel such that the wheel automatically rotates when weight is applied to the shoe.

2. The shoe of claim 1, wherein the frame comprises a front portion adapted to support a front part of the foot and a rear portion adapted to support a rear part of the foot.

3. The shoe of claim 2, wherein the front portion is pivotally mounted to the rear portion.

4. The shoe of claim 1, wherein the wheel comprises an outer surface that generally follows an Archimedean spiral.

5. The shoe of claim 1, wherein the wheel is configured to automatically rotate backward as the user's weight is applied to the shoe.

6. The shoe of claim 1, wherein the wheel is configured to automatically rotate forward as the user's weight is applied to the shoe.

7. The shoe of claim 1, wherein the shoe comprises front wheels and rear wheels.

8. The shoe of claim 7, wherein the front wheels are fixedly mounted to a front axle supported by the frame and the rear wheels are fixedly mounted to a rear axle supported by the frame.

9. The shoe of claim 1, further comprising a spring associated with the wheel that returns the wheel to an initial position after the user's weight is removed from the shoe.

10. The shoe of claim 1, further comprising a damper associated with the wheel that slows rotation of the wheel when the user applies weight to the shoe.

11. A gait-altering shoe comprising:

a frame adapted to support a user's foot, the frame including a rear portion and a front portion that is pivotally mounted to the rear portion; and wheels mounted to the rear portion of the frame that support the frame above a walking surface, each wheel having a radius that varies as a function of angular position of the wheel such that the wheel automatically rotates when weight is applied to the shoe.

12. The shoe of claim 11, wherein the wheels comprise an outer surface that generally follows an Archimedean spiral.

13. The shoe of claim 11, wherein the wheels are configured to automatically rotate backward as the user's weight is applied to the shoe.

14. The shoe of claim 11, wherein the wheels are configured to automatically rotate forward as the user's weight is applied to the shoe.

15. The shoe of claim 11, wherein the wheels include front wheels that are fixedly mounted to a front axle supported by the frame and rear wheels that are fixedly mounted to a rear axle supported by the frame.

16. The shoe of claim 15, further comprising a first spring that acts upon the front axle to return it and the front wheels to an initial position after the user's weight is removed from the front wheels and a second spring that acts upon the rear axle to return it and the rear wheels to an initial position after the user's weight is removed from the rear wheels.

17. The shoe of claim 16, further comprising a first pulley mounted to the front axle to which the first spring is coupled and a second pulley mounted to the rear axle to which the second spring is coupled.

18. The shoe of claim 15, further comprising a first damper that acts upon the front axle to slow rotation of the front wheels when the user's weight is applied to the front wheels and a second damper that acts upon the rear axle to slow rotation of the rear wheels when the user's weight is applied to the rear wheels.

19. The shoe of claim 18, further comprising a first chain or belt that couples the first damper to the front axle and a second chain or belt that couples the second damper to the rear axle.

20. The shoe of claim 11, further comprising straps attached to the frame that are adapted to secure the shoe to the user's foot.

21. A method for altering a gait cycle of a user, the method comprising:

attaching a gait-altering shoe to a foot of the user, the shoe including at least one wheel having a radius that varies as a function of angular position of the wheel and that automatically rotates when weight is applied to the wheel; and displacing the user's foot with the wheel of the shoe during a stance phase of the gait cycle.

22. The method of claim 21, wherein displacing the user's foot comprises displacing the user's foot backward in a direction opposite a direction in which the user is walking.

23. The method of claim 21, wherein displacing the user's foot comprises displacing the user's foot forward in a same direction in which the user is walking.

24. The method of claim 21, further comprising slowing rotation of the wheel using a damper of the shoe.

25. The method of claim 21, further comprising returning the wheel to an initial position using a spring of the shoe.

* * * * *